US006609387B2

(12) United States Patent
Sasaki et al.

(10) Patent No.: US 6,609,387 B2
(45) Date of Patent: Aug. 26, 2003

(54) AUGER TYPE ICE MAKING MACHINE

(75) Inventors: Makoto Sasaki, Aichi-ken (JP); Yoshio Furukawa, Aichi-ken (JP); Yuji Hirano, Aichi-ken (JP); Shigeaki Tamaki, Aichi-ken (JP)

(73) Assignee: Hoshizaki Denki Kabushiki Kaisha, Toyoake (JP)

( * ) Notice: Subject to any disclaimer, the term of this patent is extended or adjusted under 35 U.S.C. 154(b) by 0 days.

(21) Appl. No.: 10/124,411

(22) Filed: Apr. 18, 2002

(65) Prior Publication Data

US 2002/0174675 A1 Nov. 28, 2002

(30) Foreign Application Priority Data

Apr. 19, 2001 (JP) ..... 2001-120600

(51) Int. Cl.[7] ..... F25C 1/14

(52) U.S. Cl. ..... 62/125; 62/354

(58) Field of Search ..... 62/125, 129, 354

(56) References Cited

U.S. PATENT DOCUMENTS

| | | | | |
|---|---|---|---|---|
| 3,769,809 A | | 11/1973 | Robinson et al. | |
| 5,440,892 A | * | 8/1995 | Tatematsu et al. | 62/135 |
| 6,270,394 B1 | * | 8/2001 | Visaisouk et al. | 451/39 |

FOREIGN PATENT DOCUMENTS

| | | |
|---|---|---|
| EP | 0 475 500 | 3/1992 |
| JP | 4-161773 | 6/1992 |
| JP | 10-267481 | 10/1998 |
| JP | 10-325660 | 12/1998 |

* cited by examiner

*Primary Examiner*—William E. Tapolcai
(74) *Attorney, Agent, or Firm*—Wenderoth, Lind & Ponack, L.L.P.

(57) ABSTRACT

A detection device for detecting rotational abnormalities of an auger is formed within an ice making cylinder. The rotational abnormality detection device has a detecting portion made from a substrate mounted with two hall ICs, and a detection object portion made from a magnet. The detection object portion is embedded in a main body portion of the auger. Further, the detecting portion is formed so as to protrude from an inner surface of the ice making cylinder, and is placed such that the magnetic force from the detection object portion can be detected.

8 Claims, 7 Drawing Sheets

AUGER TYPE ICE MAKING MACHINE

BACKGROUND OF THE INVENTION

1. Field of the Invention

The present invention relates to an auger type ice making machine.

2. Description of the Related Art

An auger type ice making machine is structured, for example, by a driver apparatus composed of a gear motor, a coupling, a housing, and the like, an ice making cylinder disposed in an upper portion of the driver apparatus, and an evaporator disposed in the periphery of the ice making cylinder, as disclosed in Japanese Patent Application Laid-open No.4-161773 In addition, the structure has component parts, such as an auger which is driven by the driver apparatus and is disposed coaxially in the internal portion of the ice making cylinder, a pressing head (stationary blade) disposed in an upper portion of the ice making cylinder, a guide cylinder disposed in an upper portion of the compressor head, and a cutter disposed within the guide cylinder. Water for manufacturing ice is supplied to the ice making cylinder by the evaporator during ice making operation, and then the water is cooled so that a thin layer of ice forms on an internal wall surface of the ice making cylinder. Thereafter, the formed ice is scraped off by the auger, which is rotationally driven by the gear motor, while being sent upward in sequence to a compression path of the compressor. The ice is compressed when pushed up through the compression path, and made into compressed ice blocks. The compressed ice blocks are cut into an appropriate size by the cutter, and supplied continuously to the outside of the machine from the guide cylinder.

The following abnormalities may arise relating to rotation of the auger in auger type ice making machines structured as stated above. Namely, there are exemplified the following abnormalities;

(1) stoppage of auger rotation;

(2) hunting phenomenon; and (3) reverse auger rotation.

Stoppage of auger rogation, which is caused by a drop in the voltage supply, an overload on the ice making machine, etc., may lead to a phenomenon in which the load on the gear motor becomes larger, and the gear motor finally stops moving. If stoppage of auger rotation occurs, the following problems are concerned: an excessive load on the driver apparatus such as the gear motor; no performance of heat exchange in the evaporator, whereby coolant that is vaporized by a pressure reduction valve returns to liquid coolant; and damage to the compressor due to a liquid back phenomenon in which the liquid coolant is sucked back into the compressor. In addition, if the cause of auger rotation stoppage is eliminated (for example, the electric power source voltage returns), then the hunting phenomenon may develop because the evaporator is frozen.

The hunting phenomenon develops as discussed below. Since the gear motor is used for smooth upward movement of ice, the reduction ratio is large (on the order of 1:204). In a case, for example, of a sudden constraint during operation following a stoppage in auger rotation as discussed above, then a repulsive force is applied due to an impact between an output gear and a drive gear. A large torque is generated in the reverse direction, and there is a reverse operation in backlash for the entire motor. In addition, an output shaft is again constrained, and therefore a large torque, in which a stalling torque is added to a repulsive torque, acts in the direction of normal operation. The hunting phenomenon develops by repeated generation of normal torque and reverse torque. If the hunting phenomenon develops when, for any reason, the inside of the evaporator has become frozen or the load on the gear motor is larger than the stalling torque, and then there is the chance that damage will occur to the driver apparatus, such as the gear motor.

Further, reverse auger rotation starts for cases in which a phase of an electric power source voltage connection is reversed in a three phase gear motor. At this time, ice that must be conveyed upward within the ice making cylinder is pressed down so that not only can ice no longer be manufactured, but there is also the chance of significant damage to the structural components of an ice making mechanism portion.

In order to avoid the above problems caused by abnormalities in auger rotation, the following methods are conventionally employed for detecting rotational abnormalities or conditions under an influence of rotational abnormalities. Namely, there are exemplified the following methods:

(A) a method of detecting the value of the electric current of the gear motor;

(B) a method of detection in accordance with temperature; and (C) a method of detecting low voltage.

Specifically, the value of the electric current flowing in the gear motor increases due to an increase in the load applied to the gear motor caused by freeze or the like, and manufacturing is stopped by use of the method of detecting the electric current value to detect an increase in the electric current value. With the temperature detection method, heat exchange is not performed in the evaporator for cases in which a frozen state develops, and the evaporation temperature is abnormally reduced. The frozen state is thus detected by sensing the temperature reduction. A sensor for detecting insufficient voltage is used in the low voltage detection method. A reset voltage and a stop voltage are set, and manufacturing is stopped for cases in which the voltage supplied falls below the set values.

However, there are problems (i), (ii), and (iii), as shown below, associated with the conventional abnormality detection means discussed above.

Problem (i): Relating to the method (A), first, the value of the electric current is influenced by changes in the voltage. In particular, the voltage supplied to the gear motor also decreases for cases in which a frozen state develops that is caused by low voltage, and therefore the electric current value does not increase so that abnormality detection cannot be accurately performed. Second, control must be performed so that the starting current is canceled to avoid stoppage in manufacturing caused by error by a starting current that develops during initial startup. Third, there is a problem in that wire breakage and reverse auger rotation cannot be detected.

Problem (ii): Relating to the method (B), abnormality detection is performed by use of the temperature at the exit of the evaporator, but the temperature at the exit once drops to a set value during startup (caused by a large load during startup, or by the response characteristics of the pressure reduction valve). In order to avoid this, a protection circuit (manufacturing stop circuit) must therefore be canceled during a predetermined amount of time after startup. Further, the (B) method is one for detecting freeze, and there is a problem in that abnormality detection is not performed if the hunting phenomenon develops without freeze for cases, for example, in which a load greater than the stalling torque involves during ice making operation.

Problem (iii): Relating to the (C) method, the development of trouble caused by voltage drops can be prevented, but there is a problem in that the development of trouble due to overloads or other causes cannot be prevented.

SUMMARY OF THE INVENTION

The present invention has been made to solve the aforementioned conventional problems, and an object of the present invention is therefore to provide an auger type ice making machine capable of detecting abnormalities in auger rotation without depending upon the value of electric current or voltage to a gear motor, and without depending upon evaporation temperature.

In order to attain the above-mentioned object, an auger type icemaking machine according to a first aspect of the present invention is characterized by comprising: an ice making cylinder in which a layer of ice is formed on an internal surface of the ice making cylinder; an auger for scraping off ice from the layer of ice, the auger being disposed within the ice making cylinder so as to be capable of rotation; a motor for driving the auger; and an auger rotational abnormality detection means having a detecting portion and a detection object portion, one of which being attached to a movable portion that is interlocked with the auger rotation, and the other of which being attached to a stationary portion.

An auger type ice making machine according to a second aspect of the present invention is characterized in that, in the auger type ice making machine according to the first aspect of the invention, the auger rotational abnormality detection means has a detecting portion and a detection object portion, one of which being attached to the auger, and the other of which being attached to the inner surface of the ice making cylinder.

An auger type ice making machine according to a third aspect of the present invention is characterized in that, in the auger type ice making machine according to the second aspect of the present invention, the detecting portion and the detection object portion are formed at a height that is out of an ice making region or an ice scraping-off region, which are located between the auger and the ice making cylinder.

An auger type ice making machine according to a fourth aspect of the present invention is characterized by further comprising, in the auger type ice making machine according to the first aspect of the invention, a sealing means for preventing an outflow of water for manufacturing ice within the ice making cylinder, the sealing means being provided between the ice making cylinder and the auger; a coupling for connecting the auger and the motor with each other in a position at which the adhesion of the water for manufacturing ice is prevented by the sealing means; and a housing covering the coupling, in which the auger rotational abnormality detection means has a detecting portion and a detection object portion, one of which being attached to the coupling, and the other of which being attached to the housing.

An auger type ice making machine according to a fifth aspect of the present invention is characterized in that, in the auger type ice making machine according to the first aspect of the present invention, the auger rotational abnormality detection means has a plurality of the detecting portions or a plurality of the detection object portions.

An auger type ice making machine according to a sixth aspect of the present invention is characterized by further comprising, in the auger type ice making machine according to the first aspect of the invention, a determination means for determining a classification of abnormality, in which; the auger rotational abnormality detection means has a plurality of the detecting portions; and the determination means determines a specific classification of abnormality from a combination of detection results from each of the detecting portions.

An auger type ice making machine according to a seventh aspect of the present invention is characterized in that, in the auger type ice making machine according to the first aspect of the present invention, a concave portion is formed in the movable portion or in the stationary portion; and the detecting portion or the detection object portion is housed in the concave portion.

An auger type ice making machine according to an eighth aspect of the present invention is characterized in that, in the auger type ice making machine according to the first aspect of the present invention, a through hole is formed in the movable portion or in the stationary portion; and the detecting portion or the detection object portion is housed in the through hole.

DETAILED DESCRIPTION OF THE PREFERRED EMBODIMENTS

Embodiments of the present invention are explained below based on the attached figures.

Embodiment 1

Figure 1:
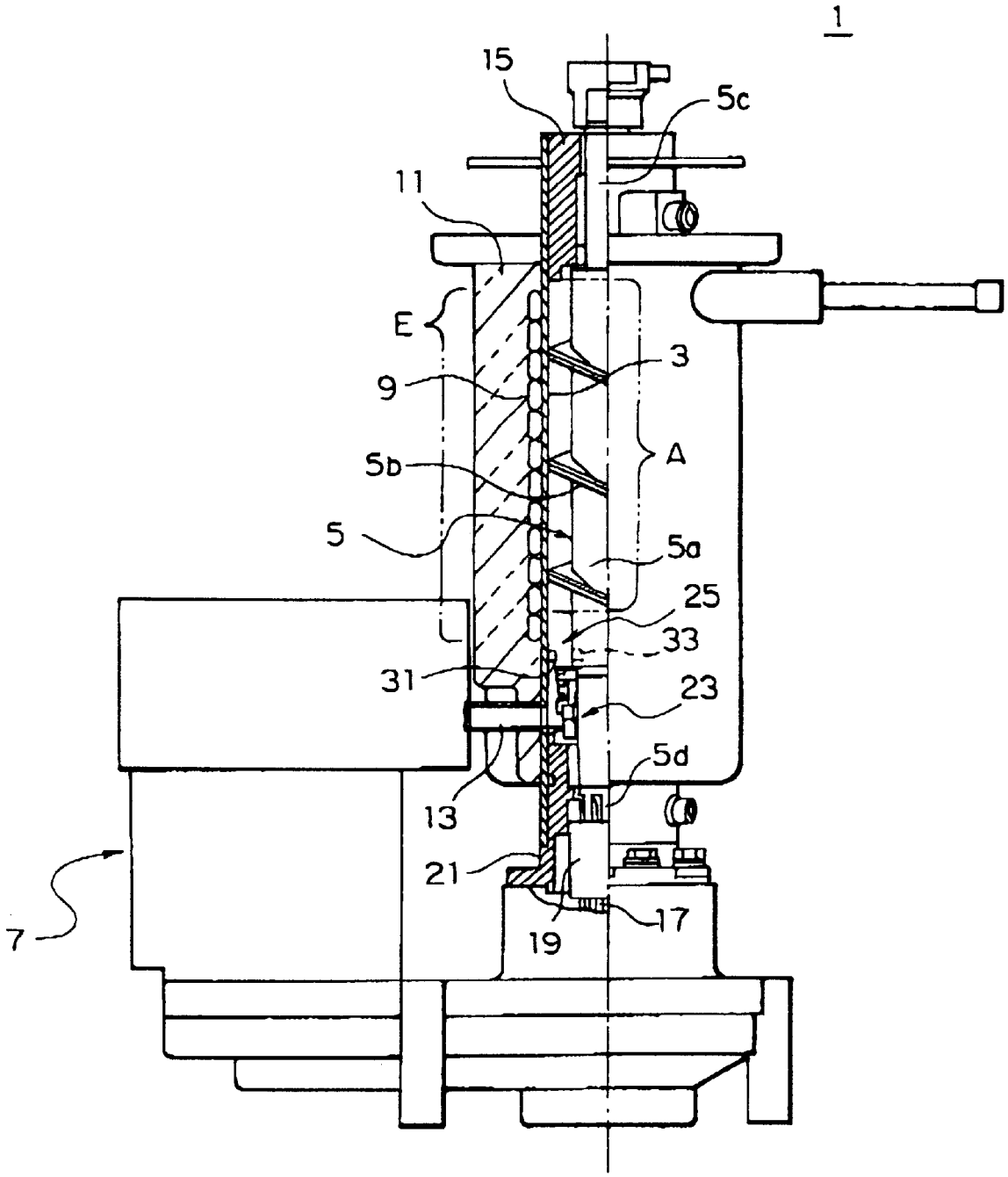
FIG. 1 is a side view diagram in a partial cross section of an auger type ice making machine according to Embodiment 1 of the present invention.
Figure 2:
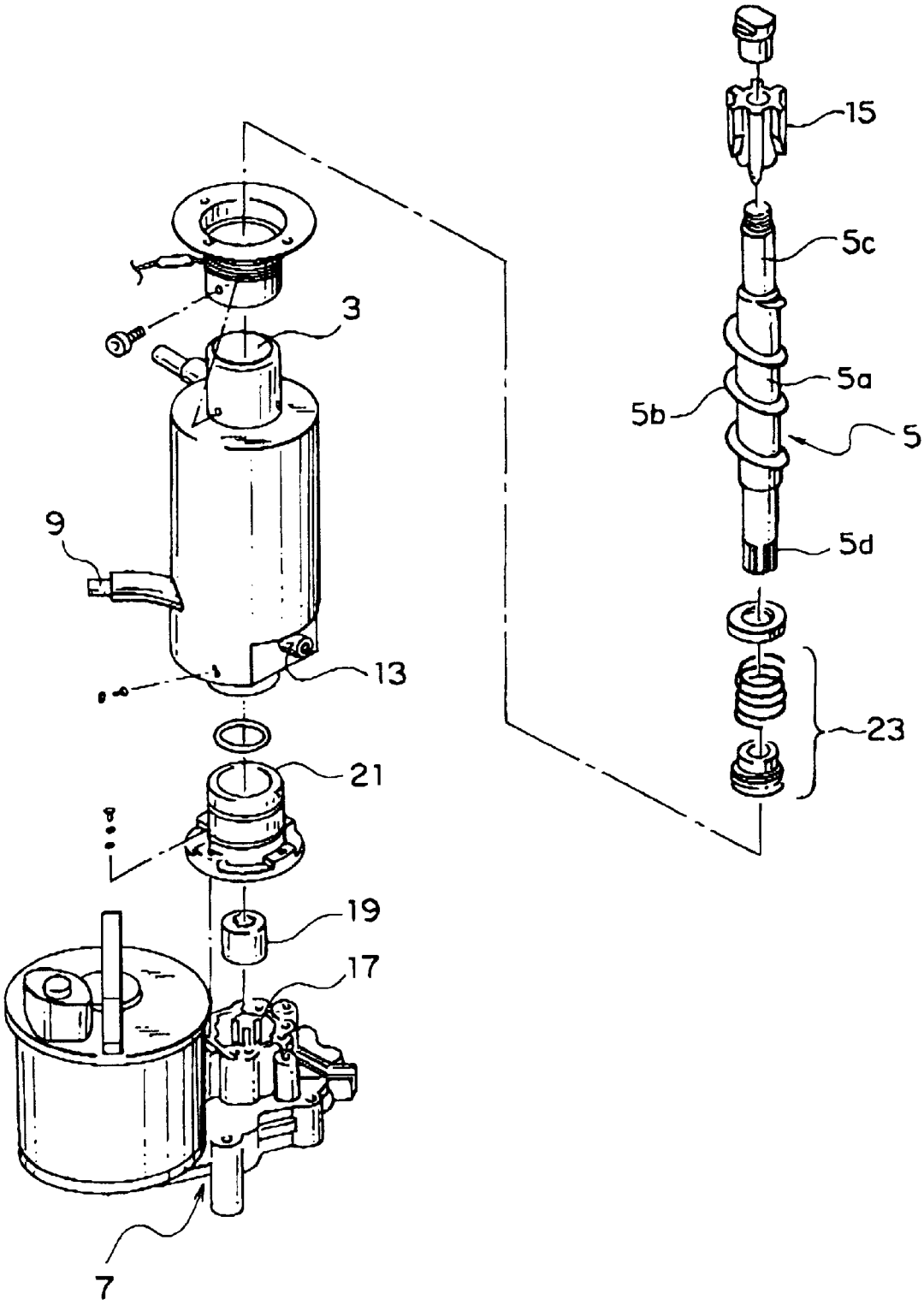
FIG. 2 is an exploded perspective view of the auger type ice making machine according to Embodiment 1 of the present invention.

FIG. 1 shows a side view in a partial cross section of an auger type ice making machine according to Embodiment 1 of the present invention. Further, FIG. 2 shows an exploded perspective view of the same auger type ice making machine. An auger type ice making machine 1 is mainly consisted of an ice making cylinder 3, an auger 5, and a gear motor 7. The ice making cylinder 3 is a cylindrical member made from a metal that is elongated in the vertical direction, and an evaporator 9 that is extended into a helical shape is provided in the outer periphery of the ice making cylinder 3. A heat insulation material 11 is formed around the evaporator 9 so as to surround both the ice making cylinder 3 and the evaporator 9. A water supply tube 13 for supplying water for manufacturing ice to an internal portion of the ice making cylinder 3 is connected to a lower portion of the ice making cylinder 3. The auger 5 is formed within the ice making cylinder 3 so as to be capable of rotation, and is prepared with a main body portion 5*a* and a helical blade 5*b* that is provided in the outer periphery thereof. An upper end 5*c* of the auger 5 is supported by a fixed blade 15. A lower end 5*d* of the auger 5 is subject to splining, and the lower end 5*d* is connected to a driving force transmission shaft 17 of the gear motor 7, similarly subject to splining, through a coupling 19. The coupling 19 is covered by a case of the gear motor 7 and by a housing 21 coupled to the ice making cylinder 3. A sealing means 23, for preventing water for manufacturing ice within the ice making cylinder from flowing out to the gear motor 7 side, is formed in the vicinity of a water supply tube 13 between the icemaking cylinder 3 and the auger 5. A mechanical seal is employed as the sealing means in Embodiment 1.

Figure 3:
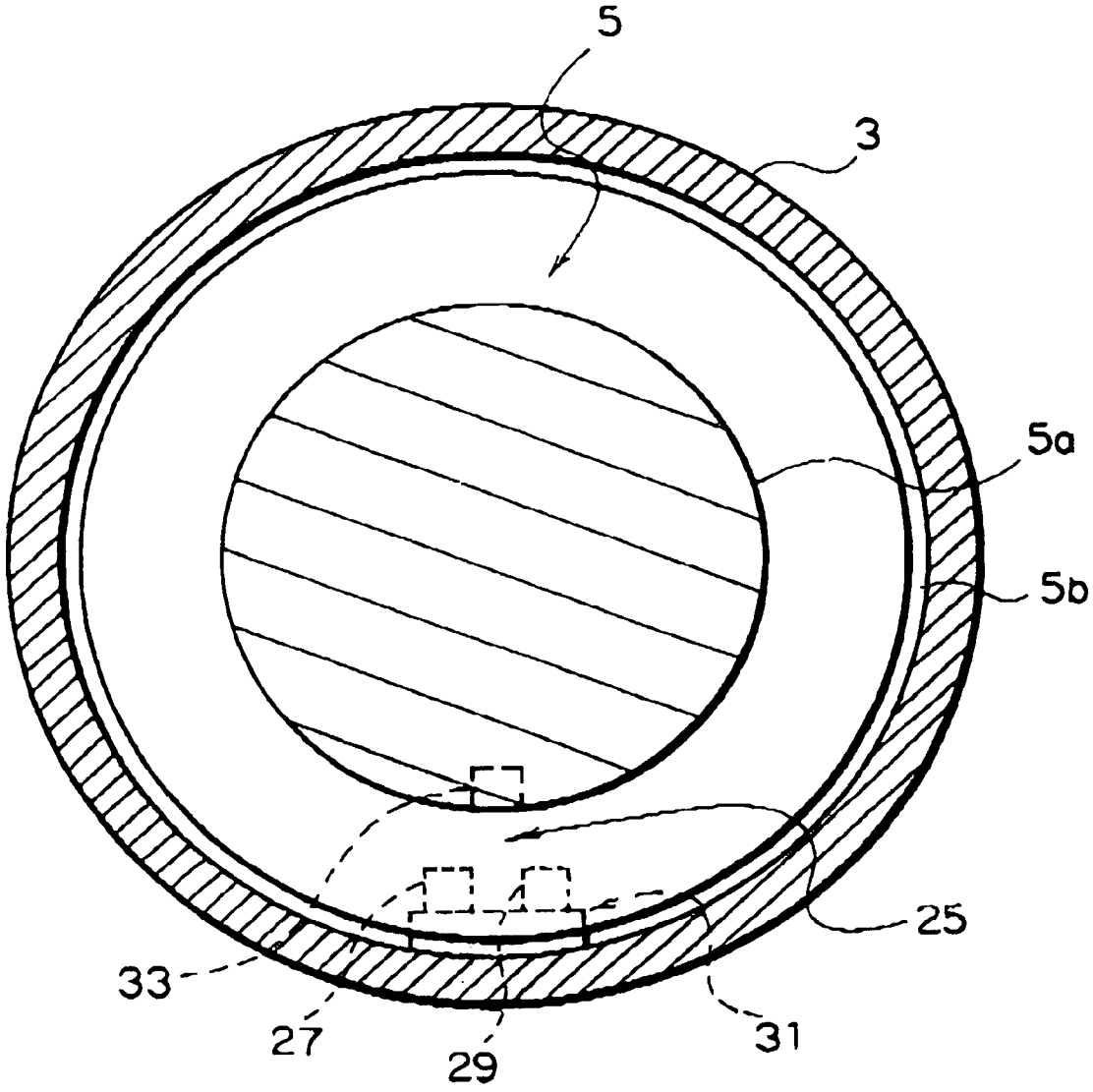
FIG. 3 is a transverse sectional view of an auger and an ice making cylinder of the auger type ice making machine according to Embodiment 1 of the present invention.

A detection means 25 for detecting rotational abnormalities of the auger 5 is prepared within the ice making cylinder 3 in Embodiment 1, as shown in FIGS. 1 and 3. The rotational abnormality detection means 25 has a detection portion 31 composed of a substrate on which two hall ICs (semiconductor magnetic sensor) 27 and 29 are adjacently mounted at nearly the same height, and a detection object portion 33 used as an object to be detected and composed of a magnet. The detection object portion 33 is built into the main body portion 5*a* of the auger 5. Further, the detection portion 31 is formed so as to protrude form the inner surface of the ice making cylinder 3, and is placed such that the magnetic force from the detection object portion 33 can be detected. Furthermore, the detecting portion 31 and the detection object portion 33 are established in a portion out of an ice scraping region A, which is determined based on the position of the upper end and the lower end of the helical blade 5*b*. Namely, they are placed in a portion below the ice scraping region A in Embodiment 1.

Next, an explanation is given regarding operation of the above stated auger type ice making machine. The water for manufacturing ice supplied within the ice making cylinder 3 is cooled by the evaporator 9, and freezes into a sheet shape on the inner surface of the ice making cylinder 3. The sheet shape ice is scraped off by the helical blade 5B of the auger 5 into a sherbet-like state, and is sent upward. The sherbet-like state ice is compacted into a rod shape in the fixed blade 15. Further, the objected to be detected portion 33 rotates in connection with the auger 5, and the detecting portion 31 directly detects the rotation state of the auger 5 by detecting the magnetic force from the detection object portion 33. If the auger 5 is determined to be in an abnormal state based on this detection result, then the manufacture of ice is stopped by stopping the gear motor 7 or by stopping the function of the refrigeration circuit (for example, by stopping a compressor not shown in the figures). Damage to parts and intermittent abnormal operation can thus be avoided, and the reliability of the ice making mechanism portion can be increased, by directly detecting the rotational state of the auger 5 without depending upon the value of the electric current or the value of voltage to the gear motor and the evaporation temperature, and without specifying what type of cause is related to the stoppage of auger rotation. Further, as a matter of course, the conventional problems (i), (ii), and (iii) discussed above are not occurred in Embodiment 1 because the value of the electric current and the value of the voltage to the gear motor, and the evaporation temperature are not utilized in detecting rotational abnormalities. Note that all types of automatic and manual stoppage methods and recovery methods for a case of stoppage may be employed. Furthermore, the conventional auger type ice making machines perform control such that the gear motor is made to operate prior to the operation of the compressor due to the aforementioned mechanism problems, and therefore it is necessary to form a phase-reversal relay in the control circuit, used for preventing phase reversal in the auger rotation. However, in Embodiment 1, it becomes possible not only to protect the aforementioned mechanism, but to prevent reverse rotation without the phase-reversal relay because the rotational state of the auger directly is detected so that a reduction in manufacturing cost can be achieved. Further, in accordance with a detection mode to directly detect the motion of the unprotected parts, the reliability of the manufactured product can be increased in comparison with a case of hypothesizing a cause of a problem and then indirectly detecting a hypothesized state. In addition, by placing the rotational abnormality detection means 25 in a portion having a height that is out of the ice scraping region A, there is no need to worry about interference between the detecting portion 31 and the helical blade 5*b* while the detection object portion 33 is attached to the auger 5 itself in order to directly detect the rotational state of the auger 5. Note that the detection object portion for detecting the rotational state is not limited to the auger itself, and may also be mounted in other portions, provided that portions should be capable of moving in concert with the auger rotation. The gear motor can be given as an example.

Embodiment 2

Figure 4:
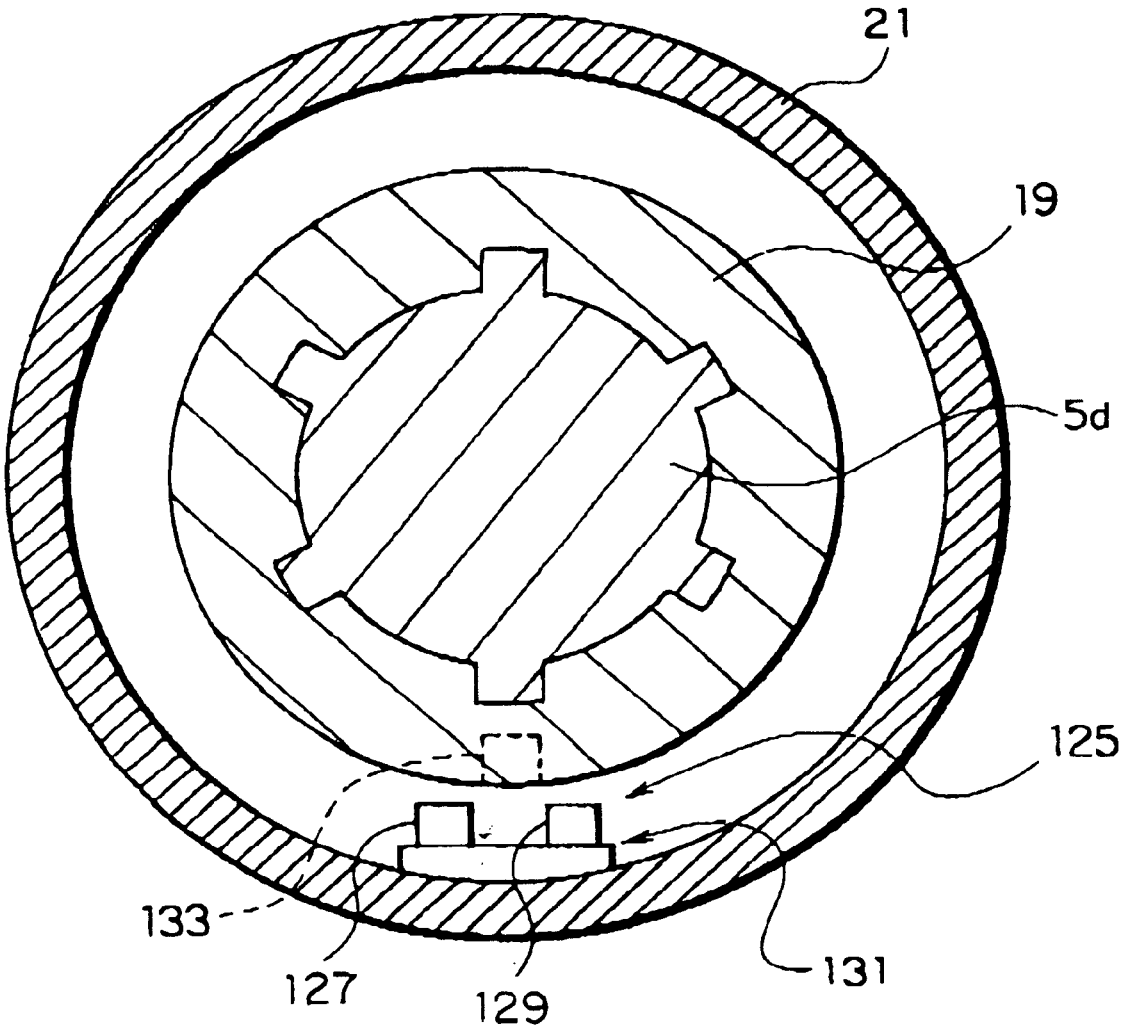
FIG. 4 is a transverse sectional view of a coupling and a housing of an auger type ice making machine according to Embodiment 2 of the present invention.

An auger type ice making machine according to a second embodiment of the present invention is explained next. The auger type ice making machine of Embodiment 2 differs from the auger type ice making machine of Embodiment 1 only in that the positions at which the detecting portion and the detection object portion are formed. As shown in FIG. 4, a rotational abnormality detection means 125 of Embodiment 2 has a detecting portion 131 made from a substrate on which two hall ICs 127 and 129 are mounted, and a detection object portion 133 composed of a magnet. The detection object portion 133 is embedded within the coupling 19 surrounding the lower end 5*d* of the auger 5. Further, the detecting portion 131 is formed so as to protrude from the inner surface of the housing 21 containing the coupling 19, and is disposed at a position where the magnetic force of the detection object portion 133 is detectable.

The auger type ice making machine having the above stated structure provides the effects discussed below, in addition to those of the ice making machine of Embodiment 1. In general, the detection precision may drop if a gap between the detecting portion and the detection object portion becomes too large. However, between the housing 21 and the coupling 19, there are no parts equivalent to the helical blade 5*b* interposed between the ice making cylinder 3 and the main body portion 5*a* of the auger 5, and therefore the gap between the detecting portion 131 and the detection object portion 133 can be made smaller than the gap between the detecting portion 31 and the detection object portion 33.

It is therefore possible in Embodiment 2 to additionally raise the precision of rotational abnormality detection of the Embodiment 1. Further, it becomes necessary to consider problems such as a cost increase and stress concentrations if the gap between the detecting portion 31 and the detection object portion 33 is to be reduced to the order of the gap between the detecting portion 131 and the detection object portion 133 because the complex shape of the auger 5, which has the helical blade 5*b*, needs to be further modified. The detection precision can be increased without facing these types of accompanying problems by attaching the detecting portion 131 and the detection object portion 133 to the housing 21 and the coupling 19, respectively. In other words, the detection precision can be increased without adding changes in the shape or the dimensions or the shape of the existing ice making cylinder 3 and the auger 5. Furthermore, existing products being in operation in the marketplace can be given the additional functionality at a low cost by attaching the detection object portion to the coupling 19, which is inexpensive in manufacturing cost as compared to the auger 5. In addition, even if the shape and dimensions of existing component parts are changed, it is possible to change the shape of the small-sized coupling 19 having a simple shape at a low cost, compared to the cost of changing the shape of the large-sized auger 5 having a complex shape, and also problems such as stress concentrations do not arise. This is because the gap between the detecting portion and the detection object portion can be made smaller.

Further, the detecting portion 131 and the detection object portion 133 are attached to the housing 21 and the coupling 19, respectively, and water for manufacturing ice within the ice making cylinder 3 is prevented by the sealing means 23 from penetrating between the housing 21 and the coupling 19. Moisture therefore does not adhere to the detecting portion 131 or to the detection object portion 133, and the precision of abnormality detection can be well maintained with certainty. In addition, this has a secondary advantage in that even it a wiring used for the detecting portion 131 penetrates into the housing 21, there is no need for a large scale sealing means for the penetration portion. Furthermore, there is no contact with ice because the detecting portion 131 and the detection object portion 133 are attached to the housing 21 and the coupling 19, respectively, so that sanitary control of the ice is easily performed.

Embodiment 3

Figure 5:
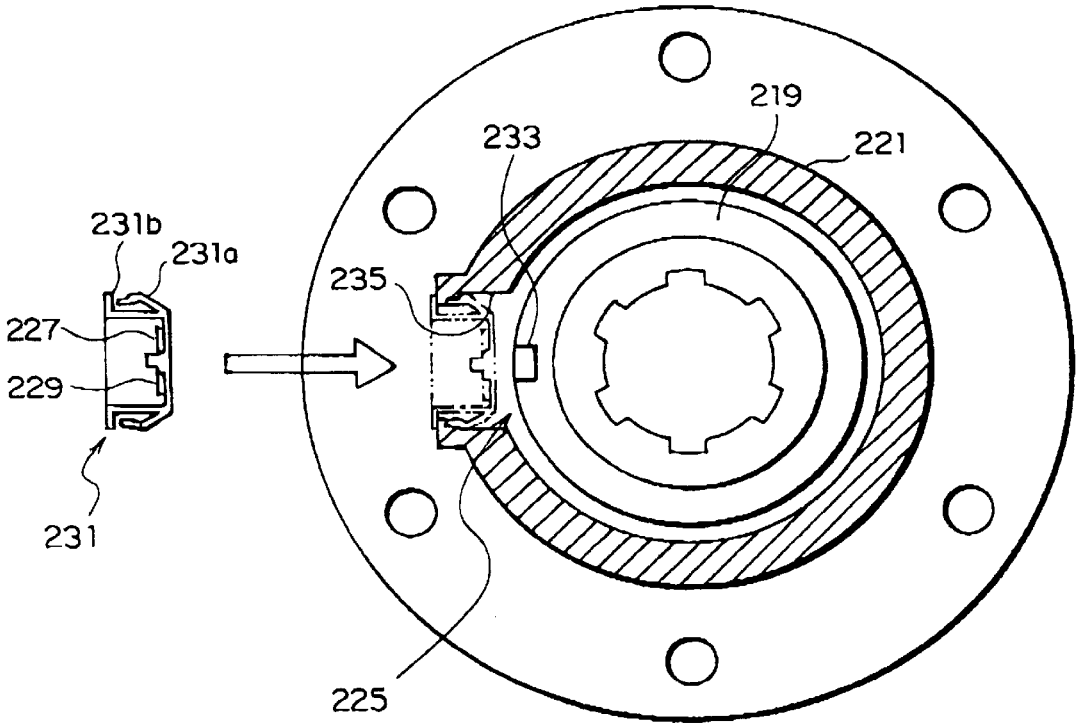
FIG. 5 is a transverse sectional view of a coupling and a housing of an auger type ice making machine according to Embodiment 3 of the present invention.

An auger type ice making machine according to a third embodiment of the present invention is explained next based on FIG. 5. In Embodiment 3, only the positions at which a detecting portion and a detection object portion are formed differs from the case of the auger type ice making machine of Embodiment 1 above. A rotational abnormality detection means 225 has a detecting portion 231 made from a substrate on which two hall ICs 227 and 229 are mounted, and a detection object portion 233 used as an object to be detected and composed of a magnet. The detection object portion 233 is embedded in a coupling 219. Further, the detecting portion 231 is inserted into a penetration hole 235 formed in a housing 221 containing the coupling 219. The detecting portion 231 is prepared with a flexible claw portion 231*a* and a stopper portion 231*b*.

The auger type ice making machine having the above stated structure provides effects discussed below, in addition to those of the ice making machine of Embodiment 2. Namely, the existing products being in operation in the marketplace can be given the additional functionality at a low cost by attaching the detecting portion to the housing 221, which is inexpensive in manufacturing cost as compared to the auger and the ice making cylinder. Furthermore, even it the shape and dimensions of existing component parts are changed, it is possible to change the shape of the small-sized housing having a simple shape at a low cost, compared with the expense of changing the shape of the large-sized auger or ice making cylinder having a complex shape, and also problems such as stress concentrations do not arise. This is because the gap between the detecting portion and the detection object portion can be made smaller. Furthermore, in the housing 221, which is a cast part, the shape of the penetration hole 235 used for attaching the detecting portion 231 thereto can be formed relatively freely. In addition, the claw portion 231*a* of the detecting portion 231 flexes and is compressed while being bent when inserted into the penetration hole 235, and is locked in by the inner surface of the penetration hole 235. The stopper portion 231*b* is engaged with the housing 221. The detecting portion 231 can thus be attached and removed without using any tools, and the installation direction becomes visible.

Embodiment 4

Figure 6:
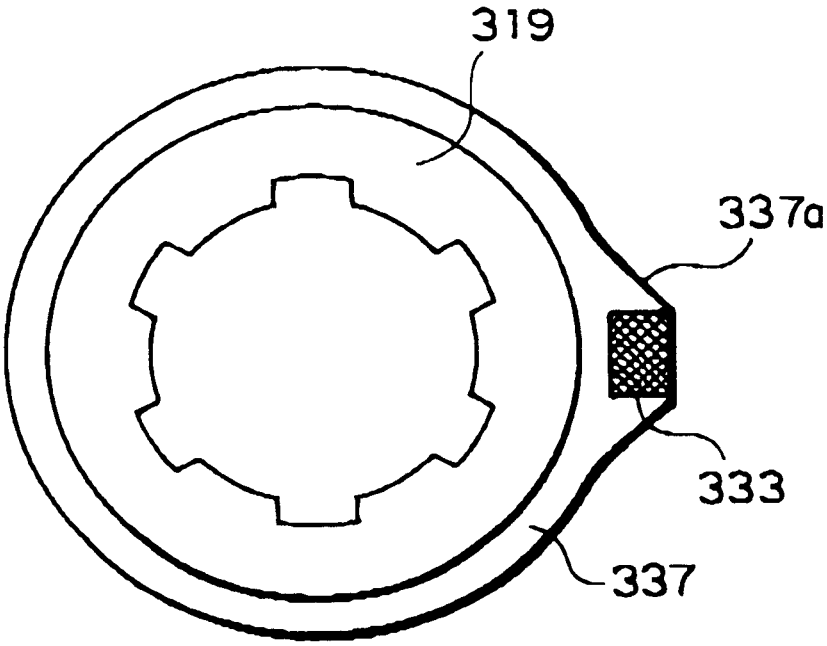
FIG. 6 is a top view conceptually showing an attachment mode a detection object portion to an auger type ice making machine according to Embodiment 4 of the present invention.
Figure 7:
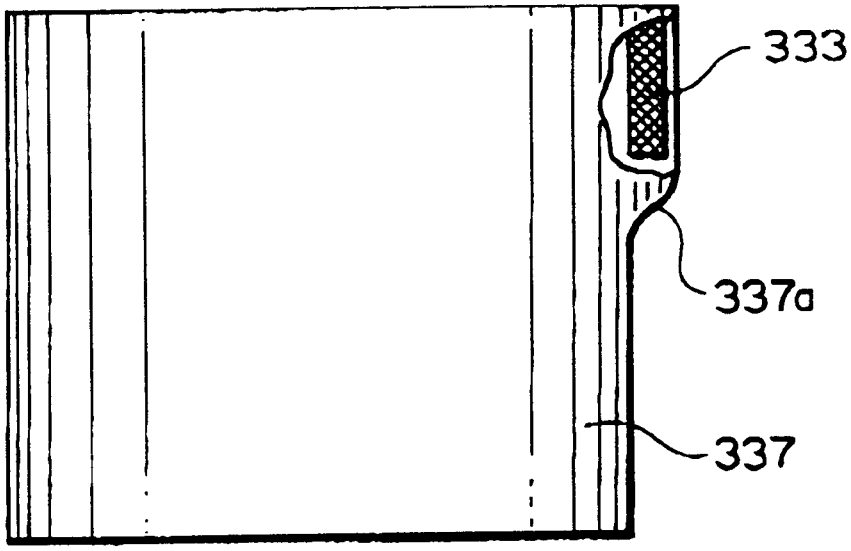
FIG. 7 is a side view conceptually showing an attachment mode a detection object portion to the auger type ice making machine according to Embodiment 4 of the present invention.

An auger type ice making machine according to a fourth embodiment of the present invention is explained next based on FIGS. 6 and 7. The installation of a detection object portion differs from that of the aforementioned embodiments. That is, an annular resin layer 337 is formed in the outer periphery of a stainless steel coupling 319, and a detection object portion 333 used as an object to be detected and composed of a magnet is seated within a concave portion formed in a built up portion 337*a* of the resin layer 337.

Compared with cases in which the detection object portion is embedded directly in the coupling, in the auger type ice making machine thus structured, the time and cost associated with machining can thus be shortened and lowered because machining of the coupling becomes unnecessary. In addition, the built up portion for optimally adjusting the distance between the detection object portion and the detecting portion can be formed by a resin material as a substitute for stainless steel, which is the same material as the coupling, so that an increase in cost can be prevented. In addition, the periphery of the detection object portion is sealed by the resin, and it is therefore possible to avoid deterioration of the magnetic itself by oxidation, and the performance of the magnet can be maintained.

Embodiment 5

Figure 8:
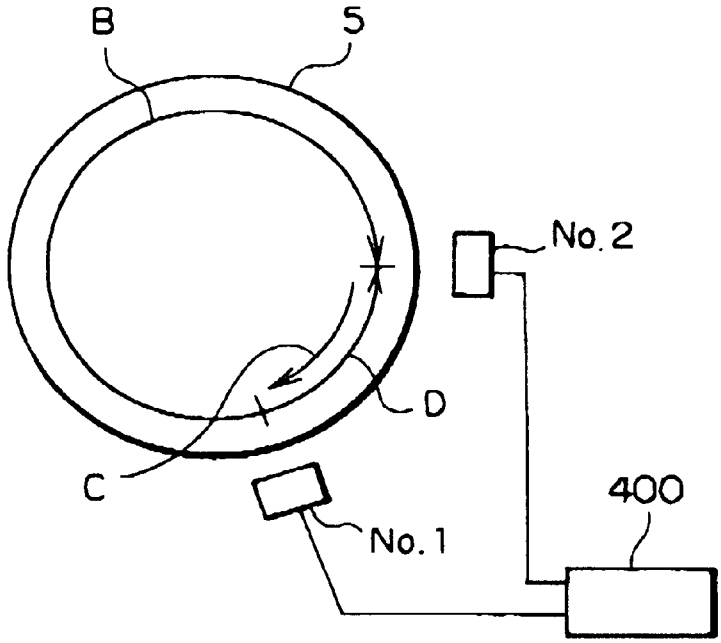
FIG. 8 is a conceptual diagram for explaining an abnormality detection mode that uses two hall ICs, according to Embodiment 5 of the present invention.
Figure 9:
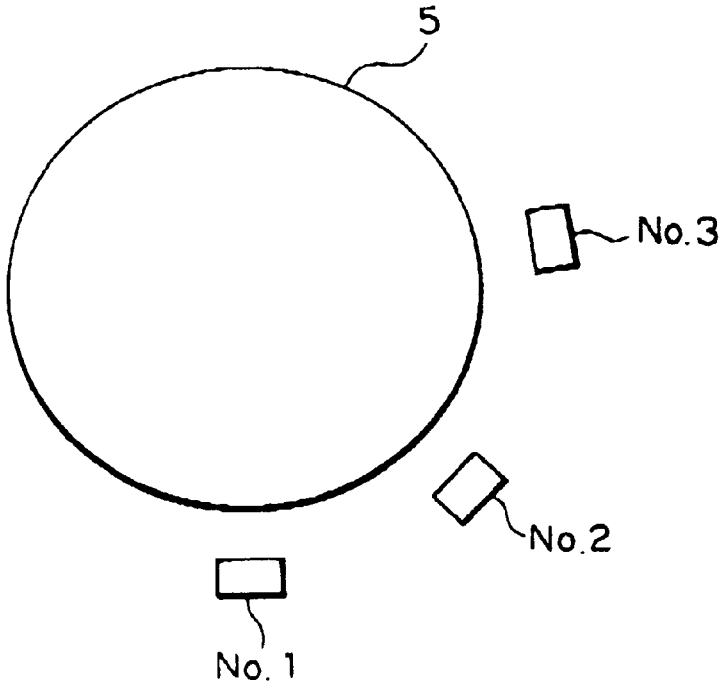
FIG. 9 is a conceptual diagram for explaining an abnormality detection mode that uses three hall ICs, according to Embodiment 5 of the present invention.

An auger type ice making machine according to a fifth embodiment of the present invention is explained next. In Embodiment 5, a specific abnormality type is inferred from a combination of results from each of the two hall ICs formed in the detecting portion in the auger type ice making machines of any one of Embodiments 1 to 4. As shown in the conceptual diagram of FIG. 8, the two hall ICs are each connected to a determination means 400. The determination means 400 determines a specific abnormality type from a combination of detection results of each of the hall ICs. Namely, if one hall IC is referred to as No. 1 and the other hall IC is referred to as No. 2, the difference in the detection timing from when the IC No. 1 makes a detection until the IC No. 2 makes the detection varies between forward rotation (a reference symbol D) and reverse rotation (a reference symbol B). Other than the degree of the difference in the detection timing between No. 1 and No. 2, decisions can be made based on the order of detections by No. 1 and No. 2 for cases in which differences in the detection timing are the same. That is because the order of detections varies in forward rotation (the reference symbol D) and reverse rotation (the reference symbol C). In this manner, reverse rotation detection can be performed. In addition, it is also possible to use three or more hall ICs, as shown in FIG. 9.

The detected state and the abnormality types detected for an example of using two hall ICs as an example are shown below in Table 1.

TABLE 1

| | Detected state | Expected abnormality type |
|---|---|---|
| 1 | No detection by No. 1 in $T_1$ seconds | 1. GM lock<br>2. Relay abnormality |
| 2 | No detection by No. 2 in $T_1$ seconds | 1. GM lock<br>2. Relay abnormality |
| 3 | No. 1 detects within $T_2$ seconds from detection by No. 2 | 1. Hunting development<br>2. Reverse rotation (phase reversal) |
| 4 | No. 2 does not detect within $T_2$ seconds from detection by No. 1 | 1. GM lock<br>2. Hunting development<br>3. Reverse rotation (phase reversal) |
| 5 | Continuous detection by No. 1 for greater than or equal to $T_2$ seconds | 1. GM lock<br>2. Relay abnormality<br>3. Hunting development |
| 6 | Continuous detection by No. 2 for greater than or equal to $T_2$ seconds | 1. GM lock<br>2. Relay abnormality<br>3. Hunting development |
| 7 | No. 1 detects again after detection by No. 1 | Hunting development |
| 8 | No. 2 detects again after detection by No. 2 | Hunting development |
| 9 | No. 1 detects within $T_3$ seconds after detection by No. 2 being turned OFF | 1. Hunting development<br>2. Reverse rotation (phase reversal) |
| 10 | Both No. 1 and No. 2 detect, then detection by No. 2 being turned OFF first | 1. Hunting development<br>2. Reverse rotation (phase reversal) |

Not only can abnormal auger rotation be found in abnormality detected state, but specific abnormality types can also be inferred, such as the hunting phenomenon, gear motor lock, relay abnormalities, and reverse rotation. In particular, there are cases in which only a detection of whether or not a rotational abnormality has developed relating to the hunting phenomenon, in accordance with the auger position or the hunting size. However, in Embodiment 5, the development of the hunting phenomenon can be detected, and also the amount of time that the abnormal state continues can be reduced to a minimum, by stopping rotation for cases in which the time, which is required for making a detection in normal rotation, elapses without detection made, in accordance with combining the detection results from each of the two hall ICs. Times $T_1$, $T_2$, and $T_3$ in Table 1 mutually differ based on their positional relationships, but should satisfy this inequality: $T_1>T_2>T_3$. Specifically, in Embodiment 5 the following values are suitable; $T_1$=11 seconds, $T_2$=3 seconds, and $T_3$=2 seconds.

The present invention as explained above is not limited to the aforementioned embodiments. Namely, either the detecting portion or the detection object portion structuring the rotational abnormality detection means may be formed in a moveable portion that moves in connection with the rotation of the auger 5, and the other may be attached to a stationary portion that does not move in connection with the rotation of the auger 5 (including portions that move individually, but not in connection with the auger 5 ). The following can therefore be given as examples of moveable portions and immobile portions: an axle on the auger and motor side, and a case containing the axle; gears on the auger and motor side, and a case containing the gears; and, as disclosed in Japanese Patent Application Laid-open No.10-267481, a stirrer in an ice making machine prepared with an ice storage container above an auger, and walls of the ice storage container holding the stirrer.

Further, the rotational abnormality detection means used in above embodiments is one prepared with the magnet and the hall ICs, but the rotational abnormality detection means is not limited to this structure. For example, magnetic and electric sensors can of course be used such as tacho generator or a proximity switch for performing detection of the amount of rotation by the amount of electricity generated due to rotation. In addition, other sensor types may also be used provided that rotation can be detected.

Further, although the detecting portion and the detection object portion are formed in a portion below a region for scraping ice in above embodiments, they may also be formed in portions at a height out of an ice making region E delineated by the position of upper and lower portions of the evaporator.

As described above, auger rotational abnormalities can be detected in accordance with the auger type ice making machine of the present invention, without depending on the value of the electric current or the value of the voltage to the gear motor or evaporation temperature, because either the detecting portion or the detection object portion, which structure the rotational abnormality detection means, is formed in a moveable portion that moves in connection with the rotation of the auger, and the other is formed in a stationary portion.

In addition, if the detecting portion and the detection object portion are formed at a height that is out of the ice making region or out of the ice scraping region between the auger and the ice making cylinder; rotational abnormality detection, and placement of the detecting portion and the detection object portion can both be performed without being concerned about the existence of ice or the helical blade.

Finally, if either the detecting portion or the detection object portion is attached to the coupling and the other is attached to the inner surface of the housing, then rotational abnormality detection and placement of the detecting portion and the detection object portion can both be performed without being concerned about the existence of moisture.

What is claimed is:

1. An auger type ice making machine, comprising:

an ice making cylinder in which a layer of ice is formed on an internal surface of the ice making cylinder;

an auger for scraping off ice from the layer of ice, the auger being disposed within the ice making cylinder so as to be capable of rotation;

a motor for driving the auger; and an auger rotational abnormality detection means having a detecting portion and a detection object portion, one of which being attached to a movable portion that is interlocked with the auger rotation, and the other of which being attached to a stationary portion.

2. An auger type ice making machine according to claim 1, wherein the auger rotational abnormality detection means has a detecting portion and a detection object portion, one of which being attached to the auger, and the other of which being attached to the inner surface of the ice making cylinder.

3. An auger type ice making machine according to claim 2, wherein the detecting portion and the detection object portion are formed at a height that is out of an ice making region or an ice scraping-off region, which are located between the auger and the ice making cylinder.

4. An auger type ice making machine according to claim 1, further comprising:

a sealing means for preventing an outflow of water for manufacturing ice within the ice making cylinder, the sealing means being provided between the ice making cylinder and the auger;

a coupling for connecting the auger and the motor with each other in a position at which the adhesion of the water for manufacturing ice is prevented by the sealing means; and a housing covering the coupling, wherein the auger rotational abnormality detection means has a detecting portion and a detection object portion, one of which being attached to the coupling, and the other of which being attached to the housing.

5. An auger type ice making machine according to claim 1, wherein the auger rotational abnormality detection means has a plurality of -the detecting portions or a plurality of the detection object portions.

6. An auger type ice making machine according to claim 1, further comprising a determination means for determining a classification of abnormality, wherein:

the auger rotational abnormality detection means has a plurality of the detecting portions; and the determination means determines a specific classification of abnormality from a combination of detection results from each of the detecting portions.

7. An auger type ice making machine according to claim 1, wherein:

a concave portion is formed in the movable portion or in the stationary portion; and the detecting portion or the detection object portion is housed in the concave portion.

8. An auger type ice making machine according to claim 1, wherein:

a through hole is formed in the movable portion or in the stationary portion; and the detecting portion or the detection object portion is housed in the through hole.

* * * * *